United States Patent [19]

Brown

[11] 4,199,076

[45] Apr. 22, 1980

[54] CUP DISPENSER

[76] Inventor: Jerry A. Brown, 3546 Newhouse Pl., Greenwood, Ind. 46142

[21] Appl. No.: 919,161

[22] Filed: Jun. 26, 1978

[51] Int. Cl.[2] ..... B65H 1/08

[52] U.S. Cl. ..... 221/45; 221/59

[58] Field of Search ..... 221/279, 280, 303, 45, 221/56–59

[56] References Cited

U.S. PATENT DOCUMENTS

| | | | |
|---|---|---|---|
| 2,273,644 | 2/1942 | Hope | 221/279 |
| 3,203,587 | 8/1965 | Mount et al. | 221/279 X |

FOREIGN PATENT DOCUMENTS

| | | | |
|---|---|---|---|
| 1062306 | 3/1967 | United Kingdom | 221/279 |

*Primary Examiner*—Allen N. Knowles

*Attorney, Agent, or Firm*—Woodard, Weikart, Emhardt & Naughton

[57] ABSTRACT

A dispenser of cups. A main body includes a cup cavity having a slidable plate mounted therein for receiving a stack of cups. A helical spring urges the plate toward the cavity opening to allow for the removal of one cup at a time from the dispenser main body. The spring is yieldable to allow a new stack of cups to be inserted into the cup cavity. A plurality of ribs within the cavity provide guide means upon which the plate moves to and from the cavity opening. The ribs have enlarged ends which project into the cavity preventing the plate from moving through the opening and insuring that only a cup at a time is removed from the dispenser. A centering plateau on the plate locates the stack of cups.

8 Claims, 5 Drawing Figures

CUP DISPENSER

BACKGROUND OF THE INVENTION

This invention is in the field of dispensers and more specifically, cup dispensers.

It is well known in the art to provide a cup dispenser which will receive a fresh stack of paper cups and which in turn will allow a cup at a time to be removed from the dispenser. Many of these dispensers are arranged to receive a vertical stack of cups with the cup being removed being located at the bottom end of the dispenser. Disclosed herein is another cup dispenser which provides different features from the prior dispensers.

The dispenser disclosed herein allows for the removal of a cup from the top end of the dispenser providing for better visibility. The dispenser is compactly designed as compared to many of the prior large cup dispensers and is provided with a number of design features which insure a better operation or more smooth insertion and removal of cups. For example, some of the prior art dispensers include means for urging the cups toward the dispenser opening. In many cases, the means become jammed or cocked as a result of loose tolerance components or because the movable component has become cocked with respect to the cavity longitudinal axis. The dispenser disclosed herein is provided with a movable plate having guides thereon which engage ribs preventing the plate from becoming cocked with respect to the cavity longitudinal axis. In addition, a raised plateau is provided on the plate to automatically align the stack of cups within the cup cavity preventing the dispenser from becoming jammed. The configuration of the main body including the ribs and movable plate is designed so that the dispenser may be molded in plastic to insure accurate tolerances and low-cost production. Further, the dispenser is designed to include ribs which project into the cavity opening to limit removal of one cup at a time from the dispenser with the ribs being integrally joined to the main body thereby eliminating the need for components such as spring-loaded detents.

SUMMARY OF THE INVENTION

One embodiment of the present invention is a dispenser of cups comprising a main body with a first and second end and including a cup cavity with opening at the first end for receiving a stack of cups, a support slidably mounted within the cavity and having a surface to receive and support the stack of cups, first means positioned within the main body and operatively engaged with the support and the main body being operable to force the support and the stack of cups toward the opening but yieldable to allow insertion of a stack of cups into the cavity, second means within the main body engaged with the support and being operable to slidably guide the support within the cavity, and third means within the main body and projecting into the cavity at location at the opening providing a passage smaller than the opening limiting movement through the opening.

It is an object of the present invention to provide a new and improved cup dispenser.

Yet another object of the present invention is to provide a cup dispenser having means for allowing the removal and/or insertion of cups while minimizing the possibility of jamming within the dispenser.

Related objects and advantages of the present invention will be apparent from the following description.

DESCRIPTION OF THE PREFERRED EMBODIMENT

Figure 1:
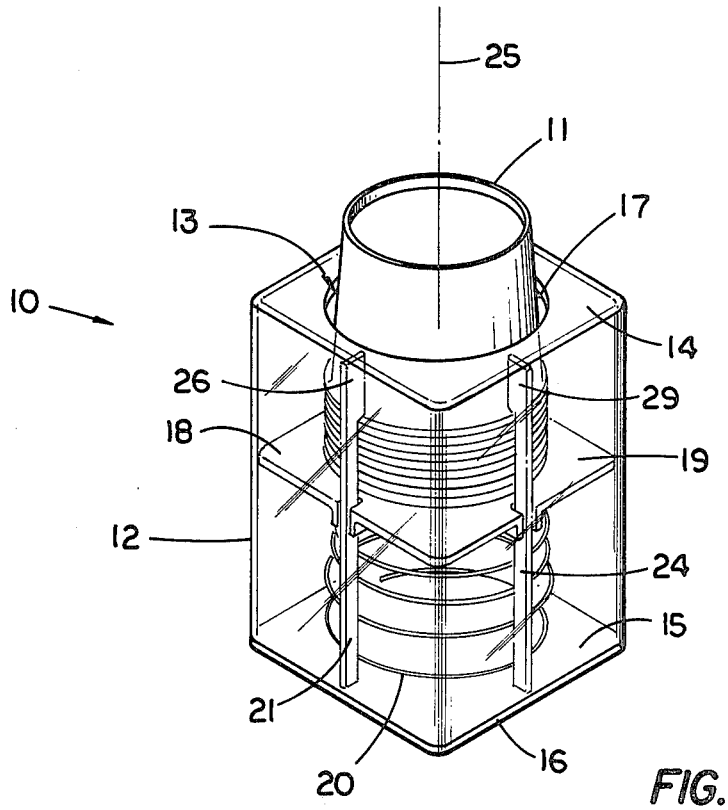
FIG. 1 is a perspective view of the preferred embodiment of a cup dispenser incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alternations and further modifications in the illustrated device, and such further applications of the principles of the invention as illustrated therein being contemplated as would normally occur to one skilled in the art to which the invention relates.

Referring now more particularly to FIG. 1, there is shown a dispenser 10 for receiving and dispensing a stack of cups 11. Dispenser 10 includes a main body 12 which in the preferred embodiment is plastic and injection molded. Main body 12 is hollow forming a cup cavity 13 at the first end 14 with the second opposite end 15 of the main body being sealingly closed by a bottom wall or plate 16 bonded to main body 12. An opening 17 is provided at end 14 allowing the cups to be inserted and removed from cavity 13.

A support 18 is slidably mounted within cavity 13 and has a top surface 19 for receiving and supporting the stack of cups 11. First means 20 is positioned within main body 12 and is operatively engaged with support 18 and wall 16 of main body 12 to force the stack of cups through opening 17. In the preferred embodiment shown in FIG. 1, the first means 20 is a helical spring which is yieldable to allow insertion of a stack of cups into the cavity.

Figure 3:
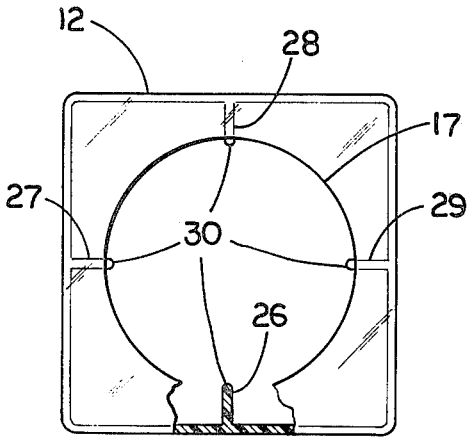
FIG. 3 is a fragmentary top view of the main body shown in FIG. 2.
Figure 4:
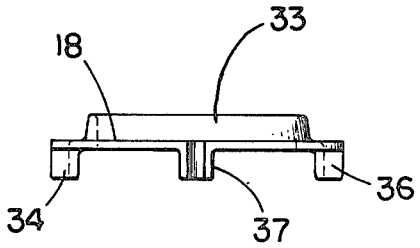
FIG. 4 is a side view of the movable plate which is slidably mounted in the main body of FIG. 2 as shown in FIG. 1.
Figure 2:
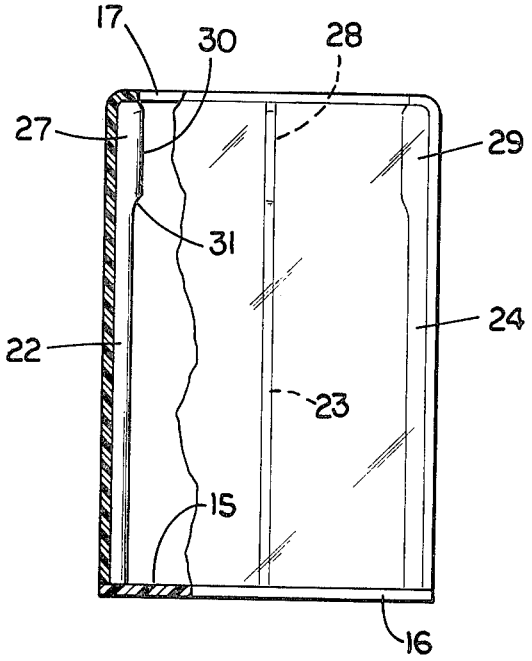
FIG. 2 is a fragmentary side view of the main body of the cup dispenser of FIG. 1.

Second means is provided within main body 12 and is engaged with support 18 being operable to slidably guide the support within the cup cavity. In the preferred embodiment disclosed in FIG. 1, the second means includes four ribs 21, 22, 23 and 24 (FIGS. 1, 2 and 3). The four ribs are integrally attached to the side walls of main body 12 and project longitudinally along the length of cup cavity 13. The four ribs are spaced at equal angles around axis 25 which extends centrally and longitudinally through cup cavity 13 and through the center of opening 17. In the embodiment shown in FIG. 1, the four ribs 21–24 are parallel to axis 25 and are spaced 90° apart from each other around axis 25.

Each rib 21–24 has an enlarged upper end or head integrally attached to a side wall of the main body. That is, ribs 21–24 have, respectively, enlarged heads 26–29 which are located adjacent opening 17 (FIG. 3). It should be noted that heads 26–29 project a distance closer to axis 25 than the remaining portion of the ribs. As shown in FIG. 3, the edge 30 of each head 26–29 projects inwardly of cup opening 17. In fact, the distance diametrically across opening 17 from one edge 30 of a rib to another edge 30 of a rib is less than the largest diameter of the cup passing through opening 17. For example, the distance from edge 30 of head 27 to edge 30 of head 29 is less than the diameter of opening 17 and also less than the largest diameter or bead diameter of the cup inserted into the dispenser. The distance from edge 30 of head 27 to edge 30 of head 29 equals the distance from edge 30 of head 28 to edge 30 of head 26. Thus, all of the cups inserted into the dispenser do not simultaneously eject from the dispenser by the action of spring 20 and instead, outwardly directed force by the user must be applied to the outermost cup to remove only the outermost cup from the dispenser in a one-at-a-time fashion. Thus, the enlarged heads provide a third means within the main body which project into the cup cavity 13 at locations at said opening 17 providing a passage smaller than opening 17 and limiting movement of cups through opening 17. The cups are temporarily deformed as they pass between the rib heads.

The enlarged heads provide an additional function of limiting movement of the slidable plate 18. The enlarged heads are blended into the ribs forming a stop surface engageable with slidable plate 18 when the plate is nearest opening 17 thereby limiting movement of the plate toward the cavity opening. For example, enlarged head 27 of rib 22 (FIG. 2) has an edge 30 which blends into rib 22 along surface 31 with surface 31 providing a stop surface engaged with plate 18 when the plate is in the most upward position. The distance 39 (FIG. 5) between the innermost surface of opposite channels 38 on channel guides 34–37 is less than the distance across the cavity from a rib to a diametrically opposite rib but is greater than the distance across the cavity from one enlarged rib head to the diametrically opposite enlarged rib head thereby providing for interference between stop surfaces 31 and channel guides 34–37 when the plate is in the uppermost position adjacent opening 17.

Figure 5:
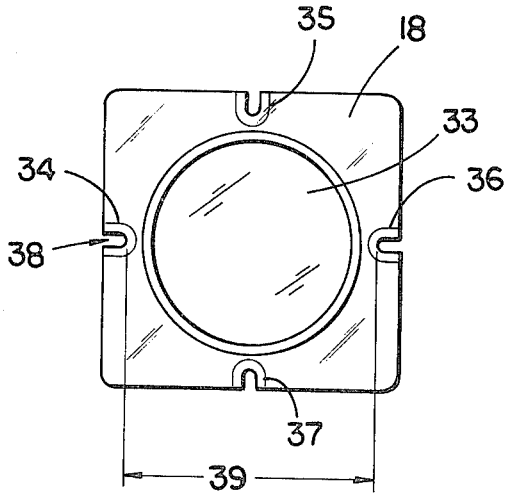
FIG. 5 is a top view of the movable plate of FIG. 4.

Movable plate 18 is a support upon which the stack of cups rests. Plate 18 includes a top surface having an upraised truncated conical plateau 33 projecting therefrom. Plateau 33 extends into the holding cavity of the lowermost cup of stack 11 thereby locating the stack of cups on the support and limiting relative movement between the stack and the slidable plate and preventing jamming of the cups within the dispenser. As shown in FIG. 5, plateau 33 has a round configuration being located centrally upon plate 18. Plateau 33 provides a fourth means within the dispenser for locating the stack of cups.

Plate 18 (FIG. 5) includes a plurality of channel guides 34 through 37 each defining a U-shaped channel 38 for slidably receiving one of the ribs 21–24. Channel guides 34–37 project and extend outwardly from the bottom surface of plate 18 a fixed distance so as to insure perpendicularity between plate 18 and ribs 21–24. That is, channel guides 34–37 extend a distance in addition to the thickness of plate 18 thereby minimizing any cocking of the plate within the dispenser.

In the preferred embodiment, the bead diameter or the largest outside diameter of the cup was approximately 0.050 inches greater than the distance between edges 30 of the enlarged heads provided at the top ends of the ribs. In the same embodiment, the dispenser was designed to receive three-ounce paper cups with the spring providing one-half pound of resistance when fully compressed and with the spring being made from 0.041 inch diameter wire having a 6-inch free length with closed ends at the opposite extremities of the coiled spring.

It will be apparent that the present invention provides a new and improved cup dispenser. It will be further apparent that the cup dispenser disclosed herein is relatively jam-proof and compact in design and relatively inexpensive to produce.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A dispenser of cups comprising:

a main body with a first and second end and including a cup cavity with opening at said first end for receiving a stack of cups;

a support slidably mounted withn said cavity and having a surface to receive and support said stack of cups;

first means positioned within said main nbody and operatively engaged with said support and said main body being operable to force said support and said stack of cups toward said opening but yieldable to allow insertion of a stack of cups into said cavity;

second means within said main body engaged with said support and being operable to slidably guide said support within said cavity; and third means within said main body and projecting into said cavity at locations at said opening providing a passage smaller than said opening limiting movement through said opening; and wherein:

said main body includes an axis extending centrally and longitudinally through said cup cavity;

said second means includes a plurality of ribs on said main body which project longitudinally along the length of said cup cavity and spaced at equal angles around said axis;

said third means includes enlarged heads on said ribs adjacent said opening with said portion projecting a distance closer to said axis than said ribs;

said enlarged heads are blended into said ribs forming stop surfaces engageable with said support when said support is nearest said opening limiting movement of said support toward said opening.

2. The dispenser of claim 1 wherein:

said support includes a surface facing said opening with an upraised, truncated, conical configuration locating said stack of cups on said support and limiting relative movement therebetween;

said support further includes a plurality of channel guides slidably engaged with said second means and projecting and extending outwardly from said support a fixed distance insuring perpendicularity between said support and said second means.

3. The dispenser of claim 2 and further comprising:

a plate fixedly mounted to said second end of said main body with said first means located between and in contact with said support and said plate.

4. The dispenser of claim 3 wherein:

said ribs are parallel to said axis and spaced 90° apart around said axis.

5. A cup dispenser comprising:

a main body with a first and second end and including a cup cavity with opening at said first end for receiving a stack of cups, said main body includes an axis extending longitudinally and centrally through said cavity;

a support slidably mounted withn said cavity and having a surface to receive and support said stack of cups;

first means positioned within said main body and operatively engaged with said support and said main body being operable to force said support and said stack of cups toward said opening but yieldable to allow insertion of a stack of cups into said cavity;

second means operable to guide said support within said cavity and including at least one rib which projects in the direction of said axis; and third means within said main body and projecting into said cavity providing a passage smaller than said opening limiting movement through said opening, said third means includes an enlarged portion on said rib adjacent said opening with said portion projecting a distance closer to said axis than said rib, said portion forms a stop surface engageable with said support when said support is near said opening limiting movement of said support toward said opening.

6. The dispenser of claim 5 wherein:

said support includes a surface facing said opening with an upraised, trucated, conical configuration locating said stack of cups on said support and limiting relative movement therebetween;

said support further includes at least one channel guide slidably engaged with said second means and projecting and extending outwardly from said support a fixed distance insuring perpendicularity between said support and said second means.

7. The dispenser of claim 6 and further comprising:

a plate fixedly mounted to said second end of said main body with said first means located between and in contact with said support and said plate.

8. The dispenser of claim 7 wherein:

said second means includes a plurality of ribs which are parallel to said axis and spaced 90 degrees apart around said axis.

* * * * *